US010259646B2

(12) United States Patent
Park

(10) Patent No.: US 10,259,646 B2
(45) Date of Patent: Apr. 16, 2019

(54) INSERT-STRUCTURED CONTAINER BAG HAVING INNER BAG TO BE INSERTED IN OUTER BAG

(71) Applicant: Chan kyung Park, Gangneung-si (KR)

(72) Inventor: Chan kyung Park, Gangneung-si (KR)

( * ) Notice: Subject to any disclaimer, the term of this patent is extended or adjusted under 35 U.S.C. 154(b) by 0 days.

(21) Appl. No.: 15/918,125

(22) Filed: Mar. 12, 2018

(65) Prior Publication Data

US 2018/0265281 A1 Sep. 20, 2018

(30) Foreign Application Priority Data

Mar. 20, 2017 (KR) ..... 10-2017-0034404
May 17, 2017 (KR) ..... 10-2017-0060808

(51) Int. Cl.
*B65D 88/16* (2006.01)

(52) U.S. Cl.
CPC ..... *B65D 88/1625* (2013.01); *B65D 88/1606* (2013.01); *B65D 88/1618* (2013.01); *B65D 88/1631* (2013.01); *B65D 88/1681* (2013.01)

(58) Field of Classification Search
CPC ..... B65D 88/16; B65D 88/1606; B65D 88/1612; B65D 88/1618; B65D 88/1625; B65D 88/1631; B65D 88/1637; B65D 88/1643; B65D 88/165; B65D 88/1656; B65D 88/1662; B65D 88/1668; B65D 88/1675; B65D 88/1681; B65D 88/1687; B65D 88/1693; B65D 88/18; B65D 88/20; B65D 88/22; B65D 88/24
USPC ..... 383/111, 119, 105
See application file for complete search history.

(56) References Cited

U.S. PATENT DOCUMENTS 4,362,199 A * 12/1982 Futerman ..... B65D 88/1681 383/17
5,938,338 A * 8/1999 McDonough ..... B65D 88/1618 220/495.06
2003/0235349 A1* 12/2003 Ricahrdson, Jr. .. B65D 88/1618 383/16

(Continued)

FOREIGN PATENT DOCUMENTS

JP 02085186 A * 3/1990 ..... B65D 88/1681
JP 05-092187 12/1993

(Continued)

OTHER PUBLICATIONS

KIPO, Notice of Grounds for Refusal of KR 10-2017-0060808 dated Jul. 7, 2017.

*Primary Examiner* — Jes F Pascua
*Assistant Examiner* — Nina K Attel
(74) *Attorney, Agent, or Firm* — Lex IP Meister, PLLC

(57) ABSTRACT

Disclosed herein is an insert-structured container bag having an inner bag inserted into an outer bag. In the insert-structured container bag having an inner bag inserted into an outer bag according to an aspect of the present invention, the inner bag includes one or more lateral reinforcing portions formed by folding the inner bag; the outer bag includes vertical reinforcing portions formed on the respective side surfaces of the outer bag, lifting loops coupled to the tops of the vertical reinforcing portions, and a connection portion passed through the lifting loops, and the lateral reinforcing portions are formed by folding the inner bag outward in a lateral direction, and are disposed in a space between the inner bag and the outer bag.

17 Claims, 15 Drawing Sheets

(56) References Cited

U.S. PATENT DOCUMENTS

2005/0196080 A1* 9/2005 Stone ..... B65D 19/06
383/119

FOREIGN PATENT DOCUMENTS

| | | | | |
|---|---|---|---|---|
| JP | 2003312775 | A | * | 11/2003 |
| JP | 2015-182787 | | | 10/2015 |
| KR | 10-2004-0027809 | | | 4/2004 |
| KR | 10-0847538 | | | 7/2008 |

* cited by examiner

INSERT-STRUCTURED CONTAINER BAG HAVING INNER BAG TO BE INSERTED IN OUTER BAG

BACKGROUND

1. Technical Field

The present invention relates to an insert-structured container bag having an inner bag inserted into an outer bag. More specifically, the present invention relates to a container bag having an insert structure, which is capable of minimizing an expansion phenomenon which is generated due to contents introduced into the container bag.

2. Description of the Related Art

The present invention relates to a flexible intermediate bulk container (FIBC; hereinafter referred to as a "container bag") which is used to pack and transport various contents, such as polypropylene (PP), polyethylene (PE), raw resin materials, raw grain materials, etc. In particular, the container bag has been contrived to pack grain or crops, to pack plastic-based synthetic resin, and to pack heavy products, such as mineral products and the like, in bulk. The container bag is also called an industrial bag, etc.

Over a long period, the container bag has been used to pack and transport heavy particle or powder materials. The container bag is made of fabric woven with threads or tapes made of polypropylene or corresponding material. The container bag has a shape in which four belts (straps) are provided on four corners or in which two belts are connected at a point.

Theoretically, such a container bag may be used to handle a load ranging from 500 to 2000 kg, and is lifted by a fork lift or crane and transported by a large-sized truck or container for the purpose of long-distance transportation.

However, the loading capacity of a general container bag is actually about 1000 kg for the sake of security. The conventional container bag is problematic in that when the conventional container bag is fully loaded and then lifted with belts on four corners or moved after being lifted, the lower portion of the body of the container bag is expanded and the upper portion of the body is contracted, and thus the container bag does not maintain an upright rectangular parallelepiped shape. This is a phenomenon which is generated because contents introduced into the container bag are moved downward due to gravity.

According to the conventional technology, partitions are formed at the corners of the internal space of the container bag in order to maintain the upright shape of the container bag. However, when the specific structure is formed in the internal space, a disadvantage arises in that a separate liner is not additionally disposed inside the internal space. In particular, the conventional technology is problematic in that it is difficult to apply the conventional technology to hygroscopic or powder material requiring a separate liner.

Moreover, there are many cases where impurities remain on the partitions formed inside the container bag during a complex manufacturing process. In particular, dust is generated or separated due to the friction between the partitions and introduced material. Accordingly, it is proved that the partitions are a cause for the generation of impurities in contents.

PRIOR ART DOCUMENT

Patent Document (Patent document 1) 1. Korean Patent No. 10-1032147 (issued on Apr. 22, 2011)

SUMMARY

An insert-structured container bag having an inner bag inserted into an outer bag according to the present invention has the following objects:

A first object of the present invention is to provide a dual structure in which an inner bag is inserted into an outer bag.

A second object of the present invention is to minimize the expansion phenomenon of a container bag when contents are introduced into the container bag.

A third object of the present invention is to keep a container bag upright while maintaining corners when materials to be transported are introduced into the container bag.

The objects of the present invention are not limited to those mentioned above, and other objects which are not mentioned herein will be clearly understood by those skilled in the art from the following description.

The present invention is directed to a container bag having a structure in which an inner bag is inserted into the internal space of an outer bag.

According to an aspect of the present invention, there is provided an insert-structured container bag having an inner bag inserted into an outer bag, wherein: the inner bag includes one or more lateral reinforcing portions formed by folding the inner bag; the outer bag includes vertical reinforcing portions formed on the respective side surfaces of the outer bag, lifting loops coupled to the tops of the vertical reinforcing portions, and a connection portion passed through the lifting loops; and the lateral reinforcing portions are formed by folding the inner bag outward in a lateral direction, and are disposed in a space between the inner bag and the outer bag.

Each of the lateral reinforcing portions may have a structure in which a bent portion is completely or partially sewn and has an internal path.

A reinforcing belt may be inserted into the internal path.

When the lateral reinforcing portions include a plurality of lateral reinforcing portions, the strengths of the reinforcing belts may increase in a downward direction.

When the lateral reinforcing portions include a plurality of lateral reinforcing portions, the heights H of the lateral reinforcing portions may increase in a downward direction.

When the lateral reinforcing portions are three or more in number, the intervals I of the lateral reinforcing portions may decrease in a downward direction.

The vertical reinforcing portions may be warp-reinforced woven portions which are woven such that warp more than weft is added thereto.

The vertical reinforcing portions may be formed by adding reinforcing belts.

The vertical reinforcing portions may be provided on the center portions of the respective side surfaces of the outer bag; and the lifting loops may be provided on the tops of the vertical reinforcing portions.

Each two of the lifting loops may be disposed in parallel.

The tops of the lifting loops may be disposed at the same height as the top of the outer bag, or may be disposed above the top of the outer bag.

The connection portion may be passed through the lifting loops which are opposite to each other with the corner of corresponding side surfaces of the container bag disposed therebetween.

The connection portion may be passed through at least two of the lifting loops.

The connection portion may be provided in a belt or string shape.

An upper plate and a lower plate may be coupled to the open top and bottom of the container bag, respectively.

A lamination layer may be formed on at least one of the outside of the inner bag and the inside of the outer bag.

A liner may be additionally disposed in the internal space of the inner bag.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
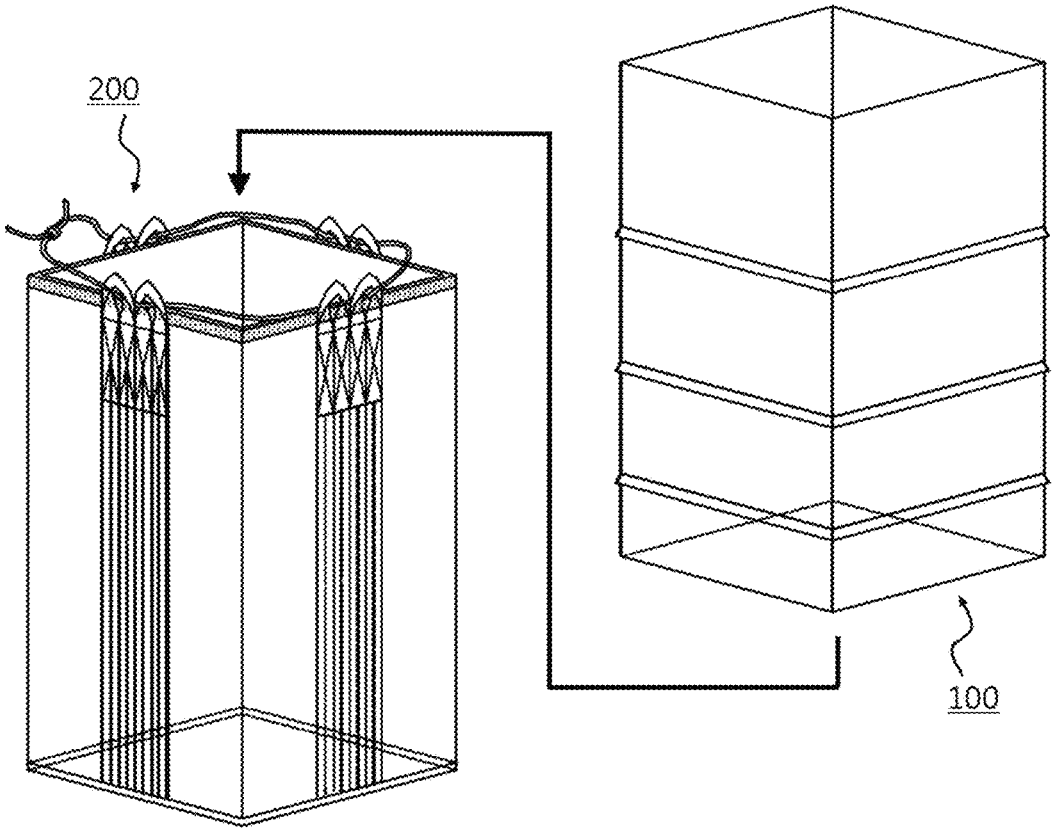
FIG. 1 shows a structure in which an inner bag is inserted into an outer bag according to the present invention.

Embodiments of the present invention will be described below with reference to the accompanying drawings so that those having ordinary knowledge in the art to which the present invention pertains can easily practice the present invention. As can be understood by those having ordinary knowledge in the art to which the present invention pertains, the following embodiments may be modified in various forms without departing from the technical spirit and scope of the present invention. Throughout the accompanying drawings, the same portions are designated by the same or similar reference symbols as much as possible.

The terms used herein are used merely to describe specific embodiments, and are not intended to limit the present invention. Each singular expression used herein may include a plural expression unless clearly defined otherwise.

The term "include" or "comprise" used herein specifies a specific feature, region, integer, step, operation, element, or component, but does not exclude the presence or addition of a different specific feature, region, integer, step, operation, element, component, or group.

All terms including technical terms and scientific terms used herein have the same meanings as commonly understood by those having ordinary knowledge in the art to which the present invention pertains. Terms defined in commonly used dictionaries should be interpreted as having meanings consistent with relevant art documents and the present invention, and should not be interpreted in an ideal or overly formal sense unless expressly so defined herein.

Meanwhile, a container bag according to the present invention includes common components which constitute a typical container bag. However, descriptions of commonly used typical components will be minimized, and the following description will be given with a focus on the principal features of the present invention.

In the following description, the technical features of the present invention will be described in conjunction with the accompanying drawings. The container bag according to the present invention is provided in a polyhedral shape which can be erected upright. However, for ease of description, the present invention will be described based on a rectangular parallelepiped shape.

The present invention is directed to a container bag having a structure in which an inner bag is inserted into the internal space of an outer bag. A method of inserting the inner bag into the internal space of the outer bag may be various. For example, there may be an embodiment in which an inner bag and an outer bag are separately manufactured and then the inner bag is inserted into the internal space of the outer bag. Furthermore, there may be an embodiment in which an outer bag and an inner bag are formed by folding container bag fabric having a single layer and thus forming two layers.

An inner bag 100 according to the present invention includes one or more lateral reinforcing portions 110 like a girdle which are formed by folding the inner bag 100. The dictionary definition of 'girdle' means a belt or cord worn round the waist or a woman's elasticated corset.

An outer bag 200 according to the present invention includes vertical reinforcing portions 210 formed on the respective side surfaces of the outer bag 200, lifting loops 220 coupled to the tops of the vertical reinforcing portions 210, and a connection portion 230 passed through the lifting loops 220.

Figure 2:
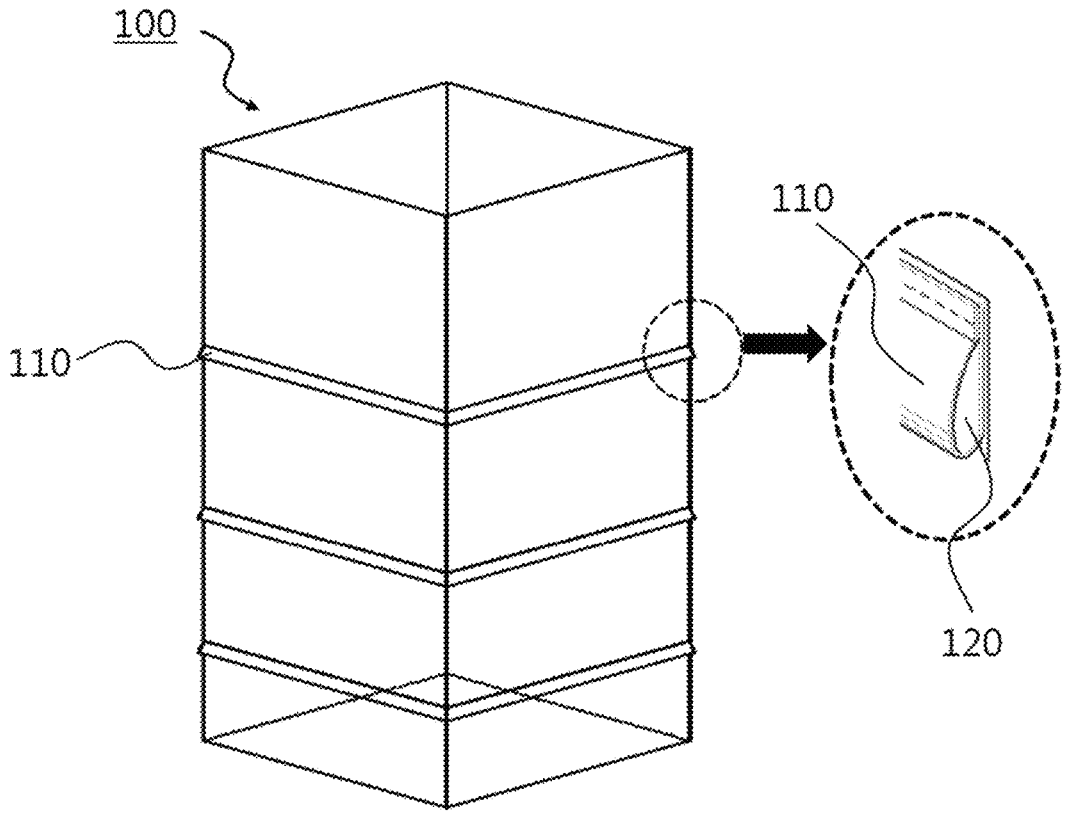
FIG. 2 shows an embodiment of the structure of the inner bag and lateral reinforcing portions according to the present invention.

FIG. 1 shows a structure in which the inner bag 100 is inserted into the outer bag 200 according to the present invention. FIG. 2 shows an embodiment of the structure of the inner bag 100 and the lateral reinforcing portions 110 according to the present invention.

The lateral reinforcing portions 110 according to the present invention are each formed by folding the inner bag outward in a lateral direction, and include one or more lateral reinforcing portions. The laterally bent portion may be completely or partially sewn.

When the laterally bent portion of each of the lateral reinforcing portions 110 is sewn, a non-sewn portion is provided with a path 120 inside which a space is formed. It is preferable that a reinforcing belt 130 is additionally inserted into the path 120 in order to enhance the prevention of the expansion phenomenon of the container bag.

In the case of the present invention, each of the inner bag and the outer bag may be provided in a single layer, the lateral reinforcing portion may be provided in two layers, and the reinforcing belt may be provided in a single layer. A portion without a lateral reinforcing portion, where the inner bag and the outer bag come into direct contact with each other, forms a total of two layers. A portion with a lateral reinforcing portion forms a total of four layers. A portion where a reinforcing belt is inserted into a lateral reinforcing portion forms a total of five layers.

The strengths of the respective reinforcing belts 130 may be the same, or may be different.

It is more preferable that when a plurality of lateral reinforcing portions 110 is provided to be spaced apart from each other, a reinforcing belt 130 inserted into a lower path 120 has a higher strength. The reason for this is that when contents are introduced into the container bag, a load is oriented downward due to gravity, and thus an expansion phenomenon is concentrated in the lower portion of the container bag.

There may be an embodiment in which the heights H of the respective lateral reinforcing portions 110 are the same or an embodiment in which the heights H of the respective lateral reinforcing portions 110 are different. Furthermore, there may be an embodiment in which the intervals I of the respective lateral reinforcing portions 110 are the same or an embodiment in which the intervals I of the respective lateral reinforcing portions 110 are different.

Figure 3:
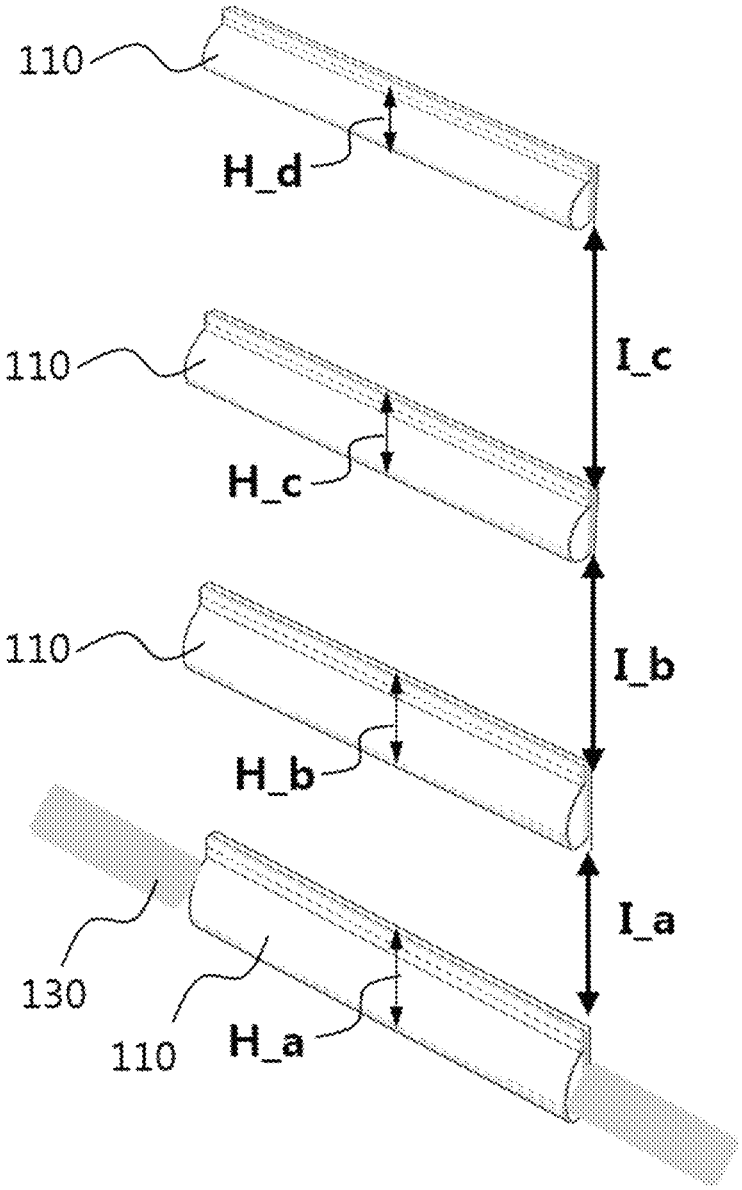
FIG. 3 shows an embodiment in which the heights H and intervals I of lateral reinforcing portions are different according to the present invention.

FIG. 3 shows an embodiment in which the heights H and intervals I of lateral reinforcing portions are different according to the present invention.

It is more preferable that when a plurality of lateral reinforcing portions 110 is provided, the height H of a lateral reinforcing portion 110 disposed in a lower portion is larger. FIG. 3 shows an embodiment in which the relationship "$H_a>H_b>H_c>H_d$" is satisfied.

It is more preferable that when lateral reinforcing portions 110 are three or more in number, the intervals I between the lateral reinforcing portions 110 decrease in a downward direction. FIG. 3 shows an embodiment in which the relationship "$I_a<I_b<I_c$" is satisfied.

When contents are introduced into the container bag, a load is oriented downward due to gravity, and thus an expansion phenomenon increases more in the lower portion of the container bag. Accordingly, it is preferable to increase the strength of the lower portion of the container bag.

As an embodiment in which the above-described embodiments are combined together, it is more preferable that the strength of a reinforcing belt 130 disposed in the lower portion of a container bag is higher, the height H of the lateral reinforcing portion 110 is larger, and a corresponding interval I is smaller.

Meanwhile, when the contents of a container bag are grain, there may be used a grain trier which pierces into the inside of the container bag from the outside of the container bag and extracts some of the grain introduced into the container bag. A grain trier is a grain extraction tool. For reference, FIG. 15 shows various types of grain triers.

If the container bag has a single layer or two layers (including an inner bag and an outer bag), a problem arises in that grain continues to be discharged through a portion which is pierced by a grain trier. Furthermore, the pierced portion may be increased and damaged.

Meanwhile, a total of three layers are obtained by adding the one layer of a reinforcing belt 130 to the two layers of the lateral reinforcing portion 110, and a total of five layers are obtained by adding the inner bag 100 and the outer bag 200 to the above three layers. Accordingly, even when a grain trier pieces a lateral reinforcing portion 110 at a location where a total of five layers are present and is taken out of the lateral reinforcing portion 110, grain is not additionally discharged. Furthermore, an advantage arises in that the pierced portion does not lead to significant damage.

Figure 4:
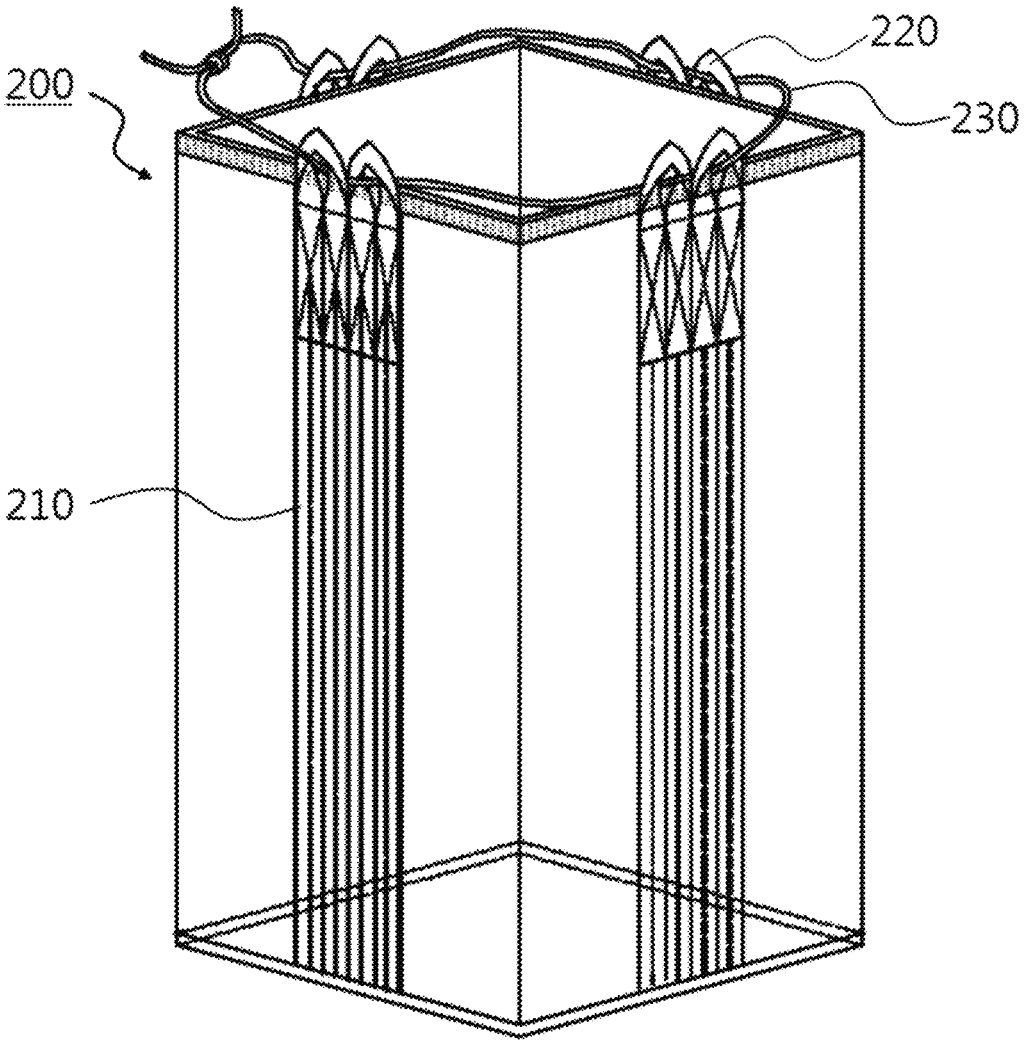
FIG. 4 shows an embodiment of the structure and technical configuration of the outer bag according to the present invention.

As shown in FIG. 4, the outer bag 200 according to the present invention includes the vertical reinforcing portions 210 formed on the respective side surfaces of the outer bag 200, the lifting loops 220 coupled to the upper portions of the vertical reinforcing portions 210, and the connection portion 230 passed through the lifting loops 220.

The vertical reinforcing portions 210 according to the present invention may be implemented in various types of embodiments. As an embodiment, it is preferable that the vertical reinforcing portions 210 are warp-reinforced woven portions 211 which are woven such that warp more than weft is added thereto. For example, two or three stands of warp are woven relative to a single strand of weft. Accordingly, the present embodiment is an embodiment in which the vertical reinforcing portions 210 are formed at the step of weaving container bag fabric.

The vertical reinforcing portions 210 may be formed by adding and sewing reinforcing belt-shaped structures (not shown) after container bag fabric has been woven.

Meanwhile, a structure in which a container bag fabric on which vertical reinforcing portions 210 are formed at a weaving step is cut into an inner bag and an outer bag and the inner bag 100 is inserted into the outer bag 200 may be also included in the present invention.

Figure 5:
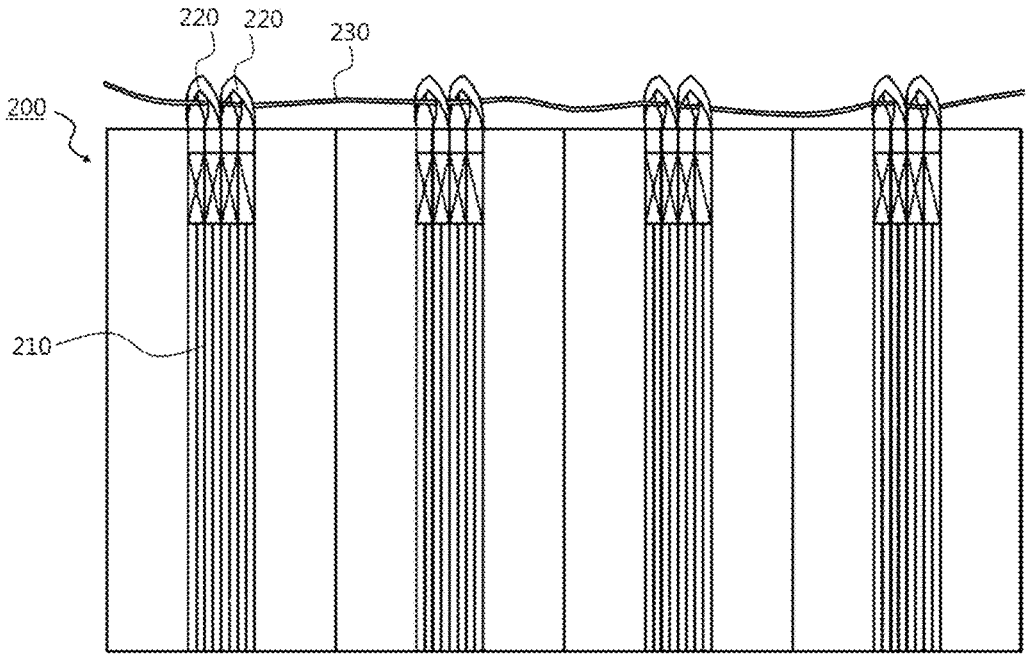
FIG. 5 shows a state in which the outer bag of FIG. 4 is spread laterally in order to illustrate the structure of the outer bag of FIG. 4.

FIG. 5 shows a state in which the outer bag 200 of FIG. 4 is spread laterally in order to illustrate the structure of the outer bag 200 of FIG. 4. As shown in FIG. 5, it is preferable that the vertical reinforcing portions 210 are provided on the center portions of the side surfaces of the outer bag 200.

It is preferable that one or two lifting loops 220 according to the present invention are provided for each side surface. More specifically, as shown in FIG. 5, two lifting loops 220 are disposed on the top of each vertical reinforcing portion 210 in parallel.

Although the height of the tops of the lifting loops 220 according to the present invention is not limited, it is preferable that the tops of the lifting loops 220 are disposed at the same height as the top of the outer bag or above the top of the outer bag.

The connection portion 230 according to the present invention is applicable as long as it has one of various structures and shapes which enable passage through the lifting loops 220. Although the connection portion 230 is generally provided in a string shape, the connection portion 230 may have a belt shape or the like. In the present specification and the accompanying drawings, there is described an embodiment in which the connection portion 230 is provided in a string shape.

The connection portion 230(Z) is passed through a plurality of lifting loops. All types of connection portions capable of enabling passage are included in the present invention.

Meanwhile, in the present invention, in order to maintain an upright shape and a rectangular parallelepiped shape, variations attributable to a structure in which the connection portion 230 is passed through the lifting loops 220 have been examined.

Figure 9:
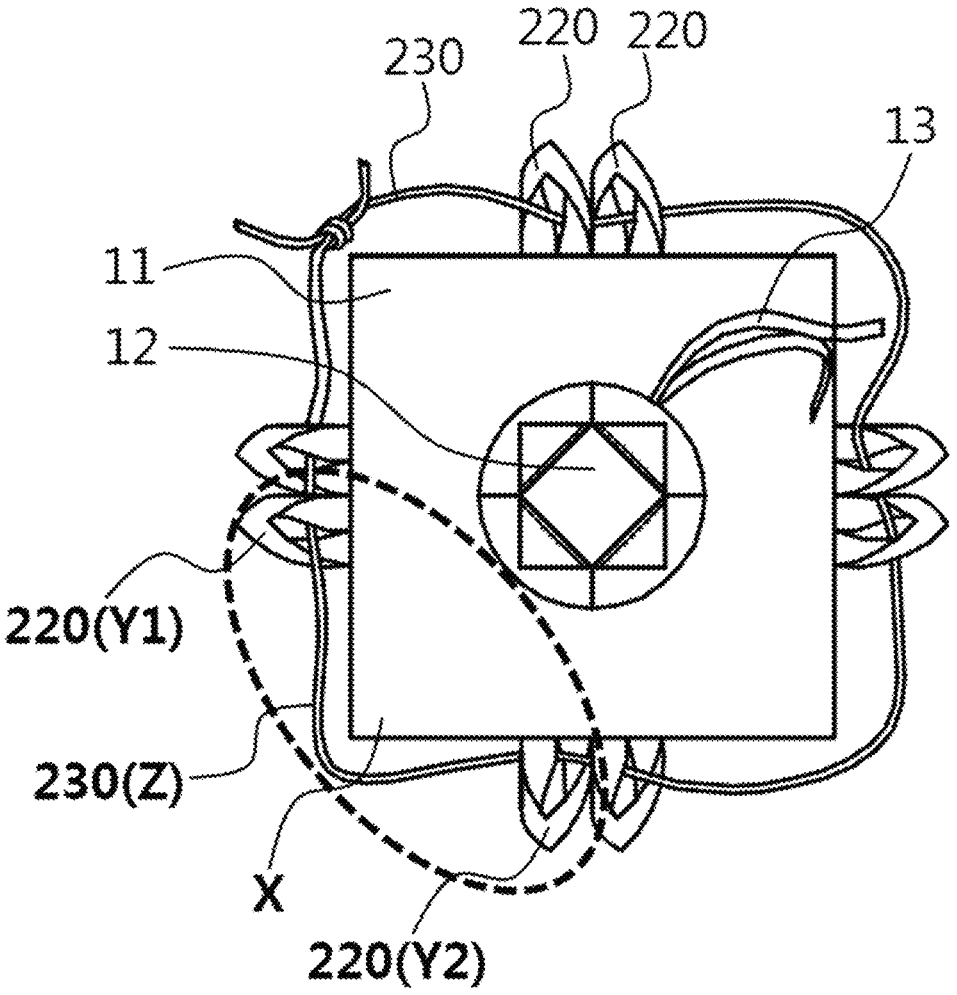
FIGS. 9*a* and 9*b* are a plan view and a bottom view showing an embodiment in which an upper plate and a lower plate are coupled to the container bag according to the present invention.
Figure 9:
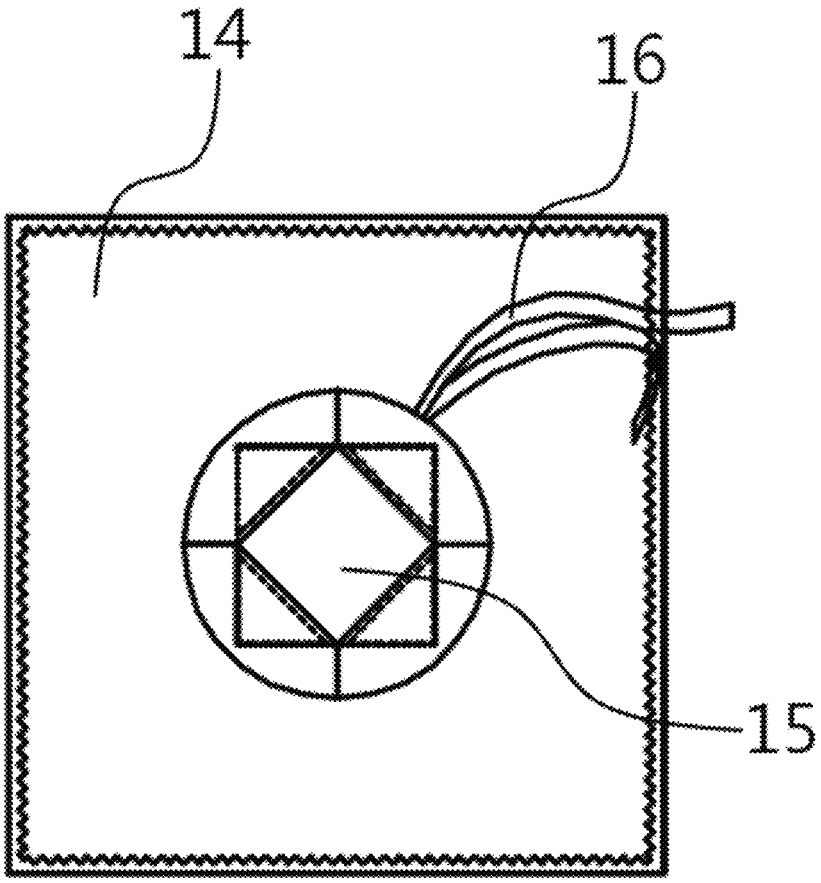
Figure 10:
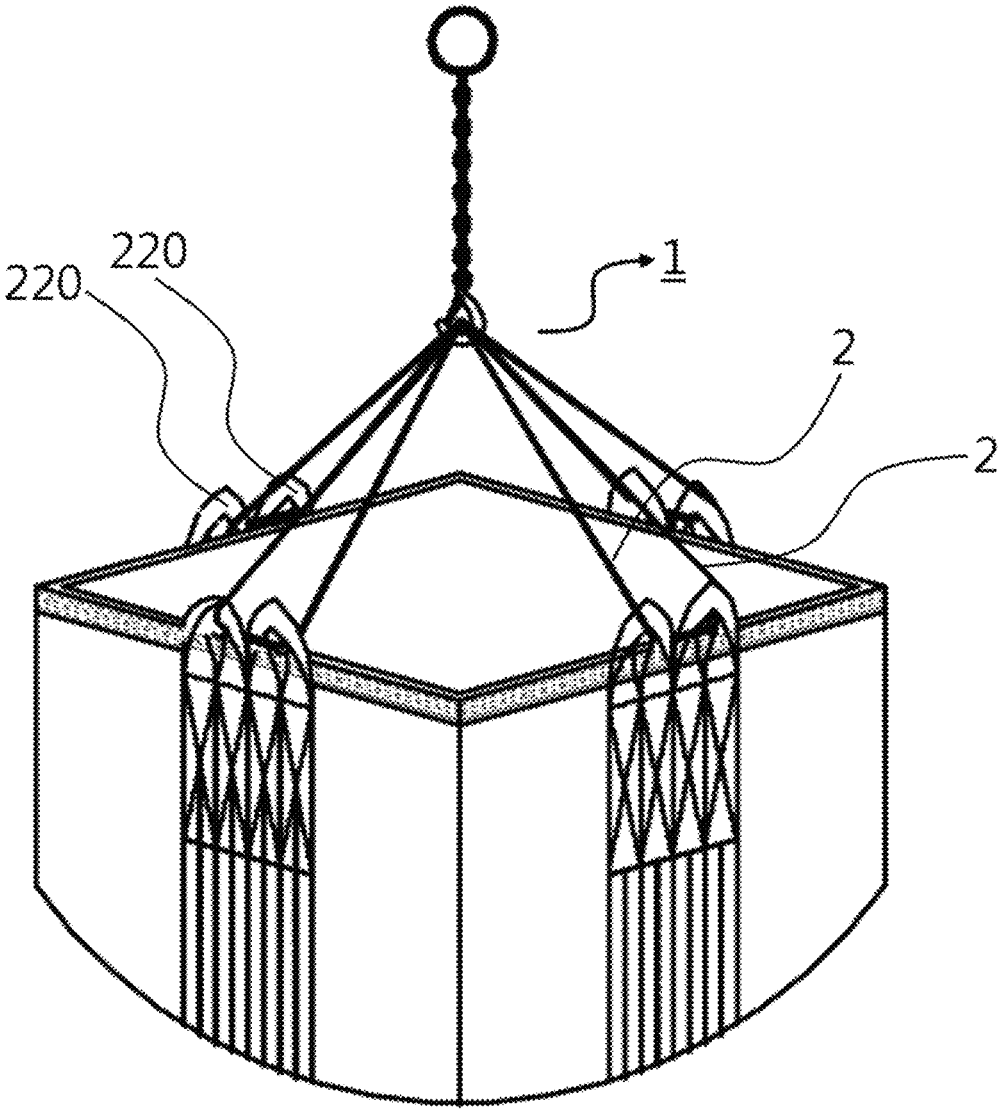
FIG. 10 shows a state in which a lifting string has been separately passed through lifting loops formed on the top of the outer bag.

As a result, as shown in FIG. 9*a*, it is preferable that a connection portion is passed through lifting loops 220(Y1) and 220(Y2) with the corner X of corresponding side surfaces of the container bag disposed therebetween.

The connection portion 230 may be passed through at least two lifting loops 220. More preferably, the connection portion 230 is passed through all the lifting loops 220.

Figure 11:
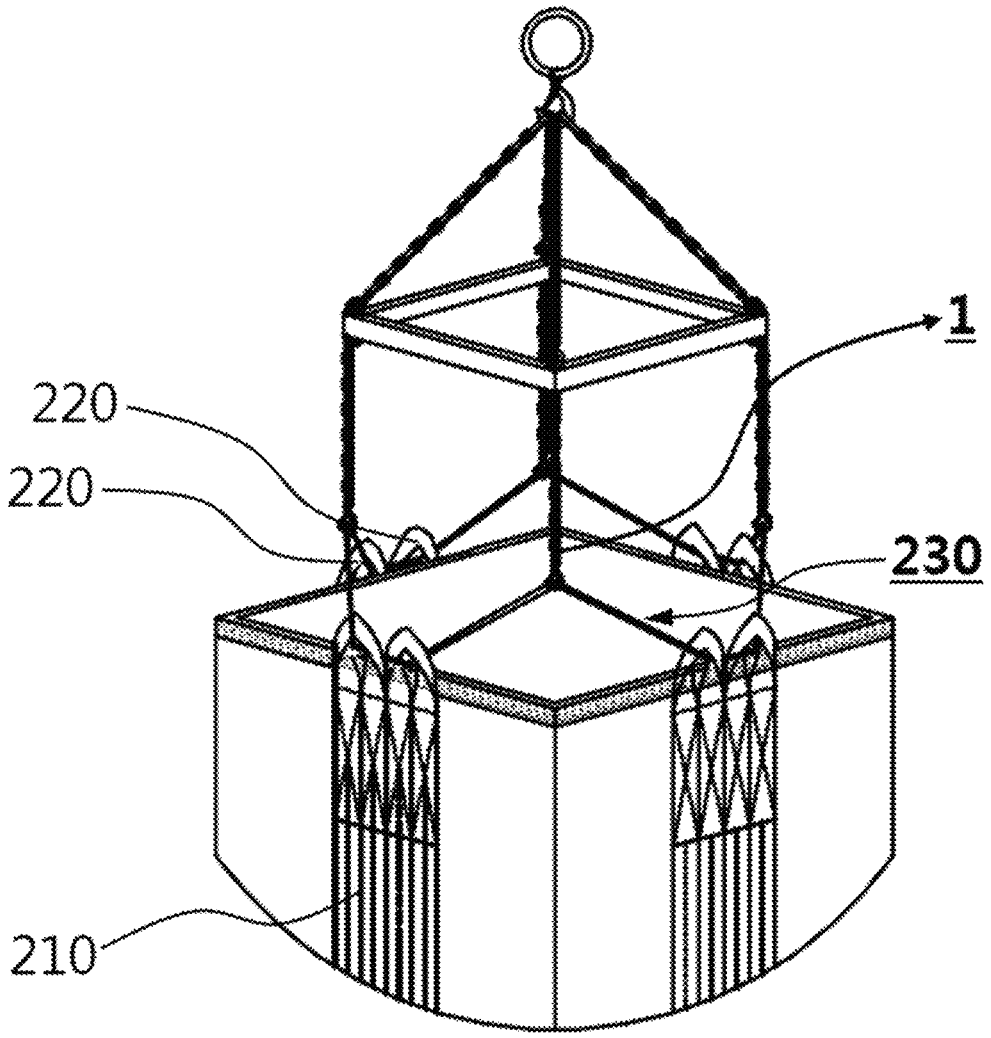
FIGS. 11*a* and 11*b* show an embodiment in which a lifting device is coupled to the connection portion according to the present invention and lifts the connection portion.
Figure 11:
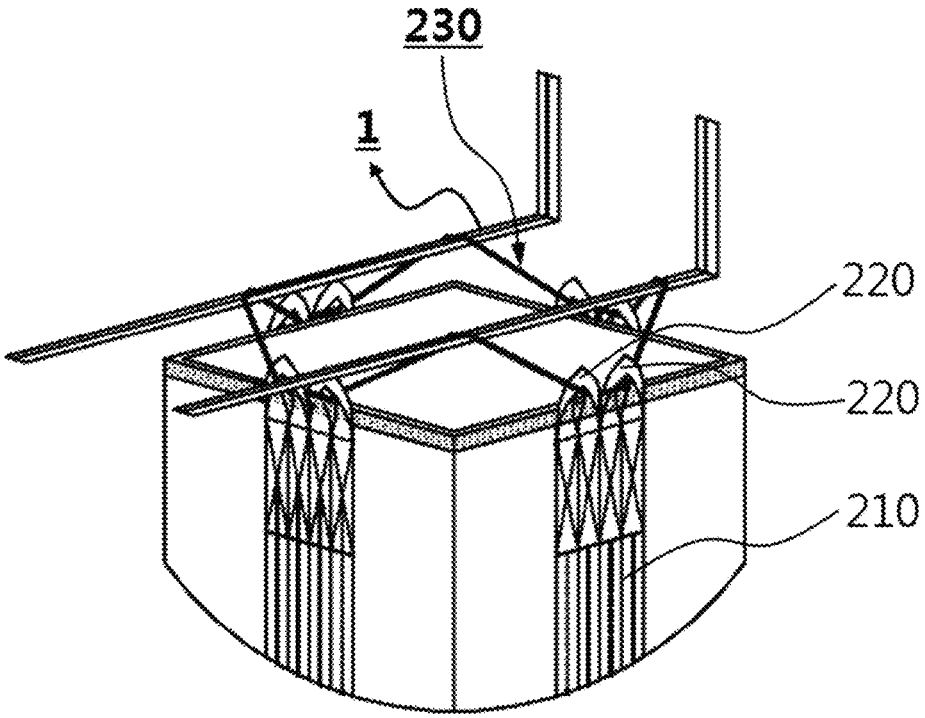
Figure 12:
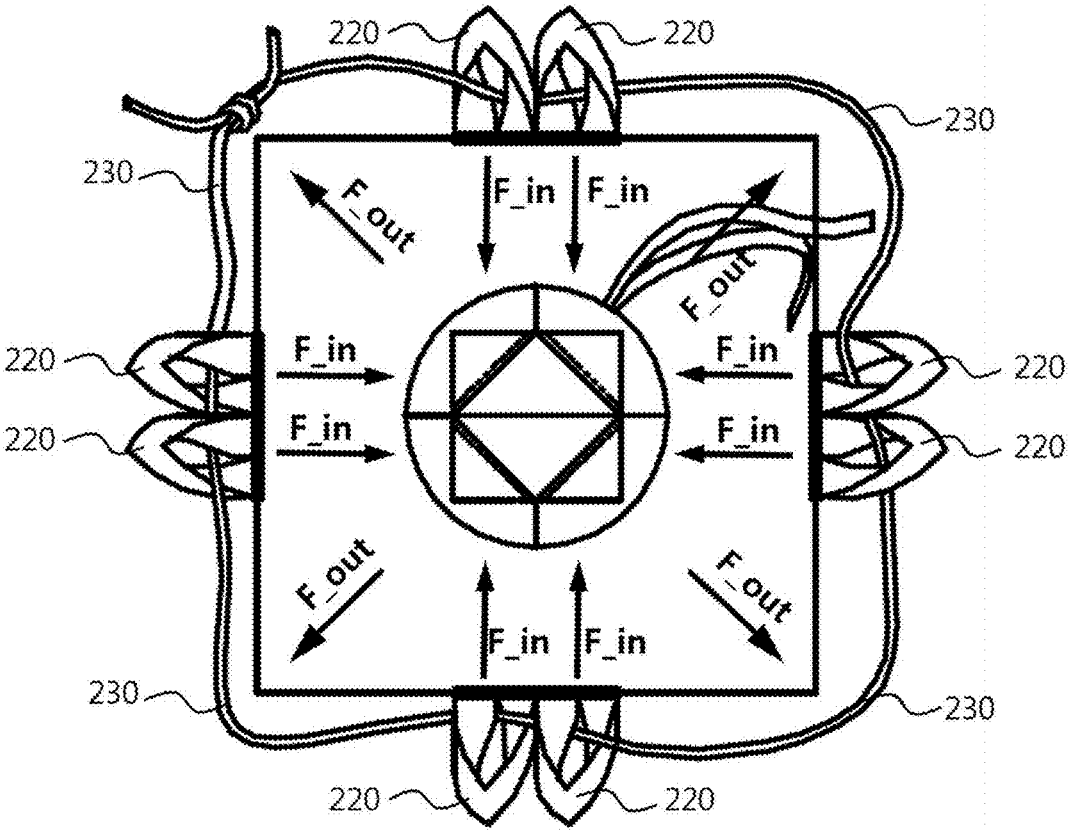
FIG. 12 shows the types and directions of forces which are applied to the inside of the container bag according to the present invention when the container bag is lifted.
Figure 13:
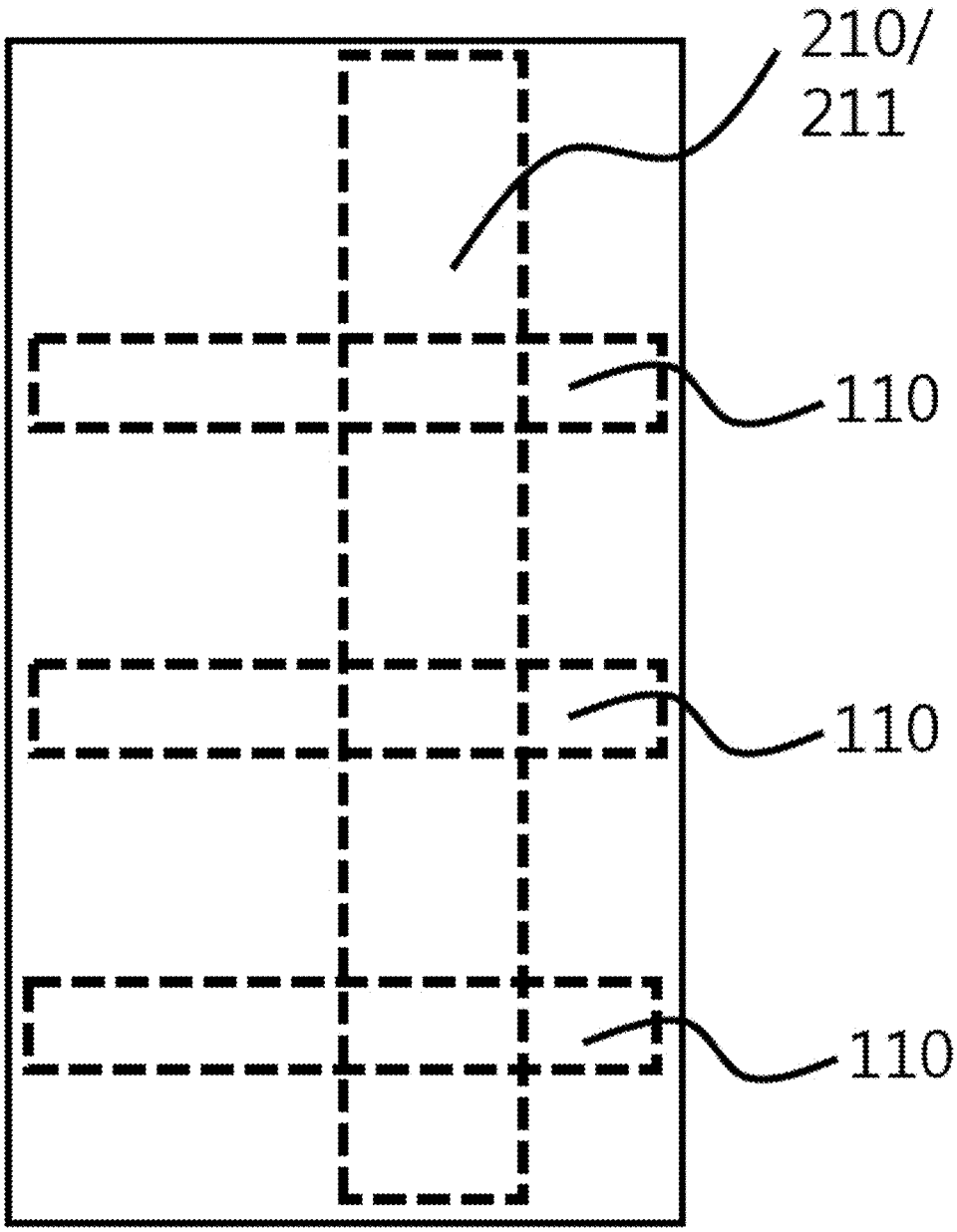
FIG. 13 shows an embodiment in which contents have been introduced into an actual product of the container bag according to the present invention and the actual product has been erected upright.

FIGS. 11*a*, 11*b* show an embodiment in which a connection portion is passed through opposite lifting loops with corners disposed therebetween. In this embodiment, when a container bag is lifted, forces are applied to the container bag, as shown in FIG. 12.

In other words, when the lifting loops 220 are lifted, forces F_in oriented from the lifting loops to the inside of the container bag are applied. Meanwhile, forces F_out oriented out of the container bag are applied toward corners each present between a lifting loop on one side surface and a lifting loop on another side surface by the connection portion 230 which connects lifting loops 220 with corners disposed therebetween.

When the directions and strengths of forces inside the container bag are balanced by the above-described components, such as the vertical reinforcing portions 210, the lifting loops 220, the connection portion 23, etc., of the outer bag 200, the corners of the container bag are maintained, or the content introduced into the bag would be automatically distributed into the corner and thus the rectangular parallelepiped shape of the container bag can be maintained.

Meanwhile, a load is applied downward by introduced contents due to gravity. In this case, the expansion phenomenon of the lower portion of the container bag is prevented by the lateral reinforcing portions 110 of the inner bag 100. Accordingly, an overall upright and rectangular parallelepiped shape is maintained.

Figure 6:
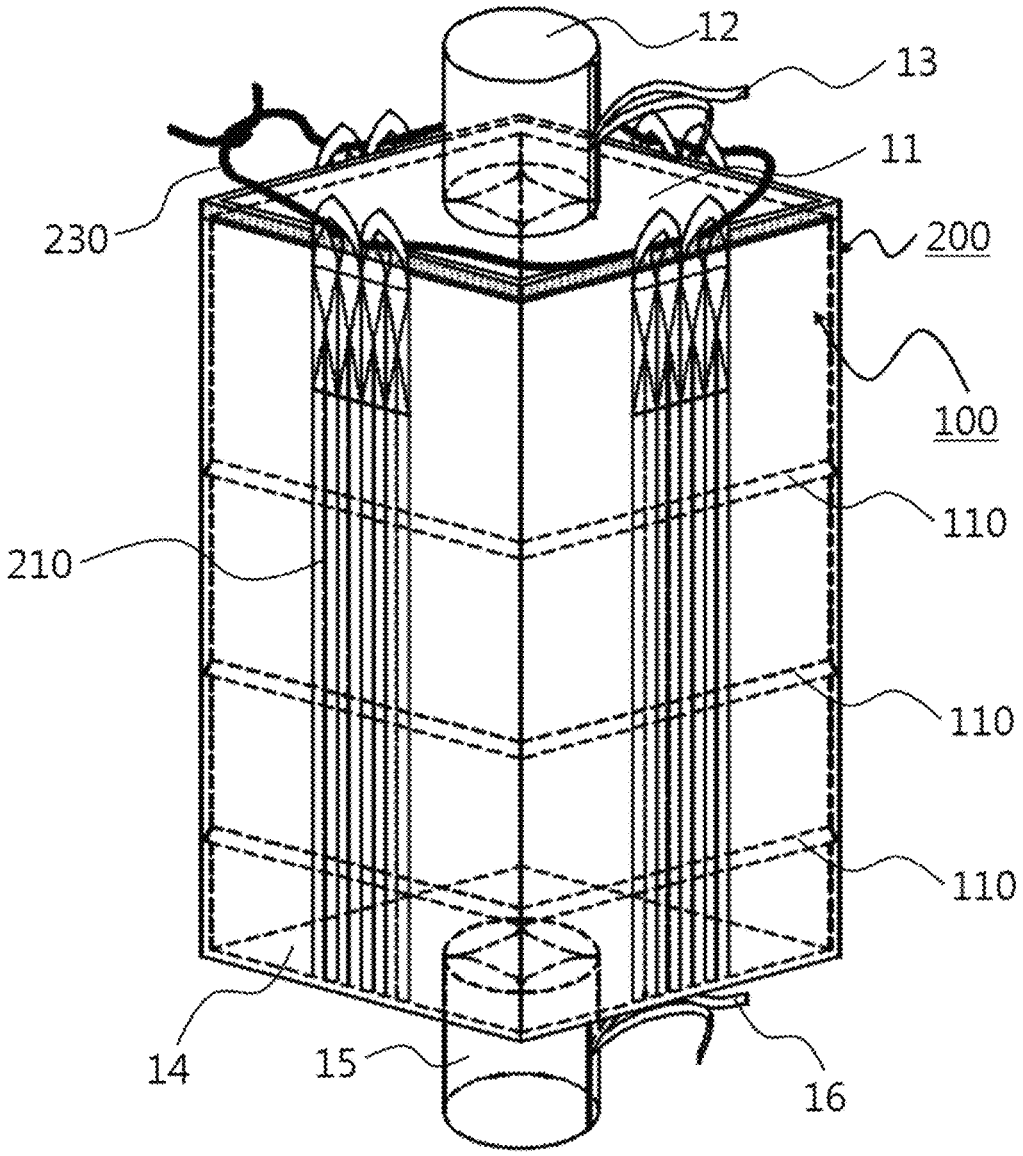
FIG. 6 shows the structure of the inner bag using dotted lines in a state in which the inner bag has been inserted into the outer bag according to the present invention.
Figure 7:
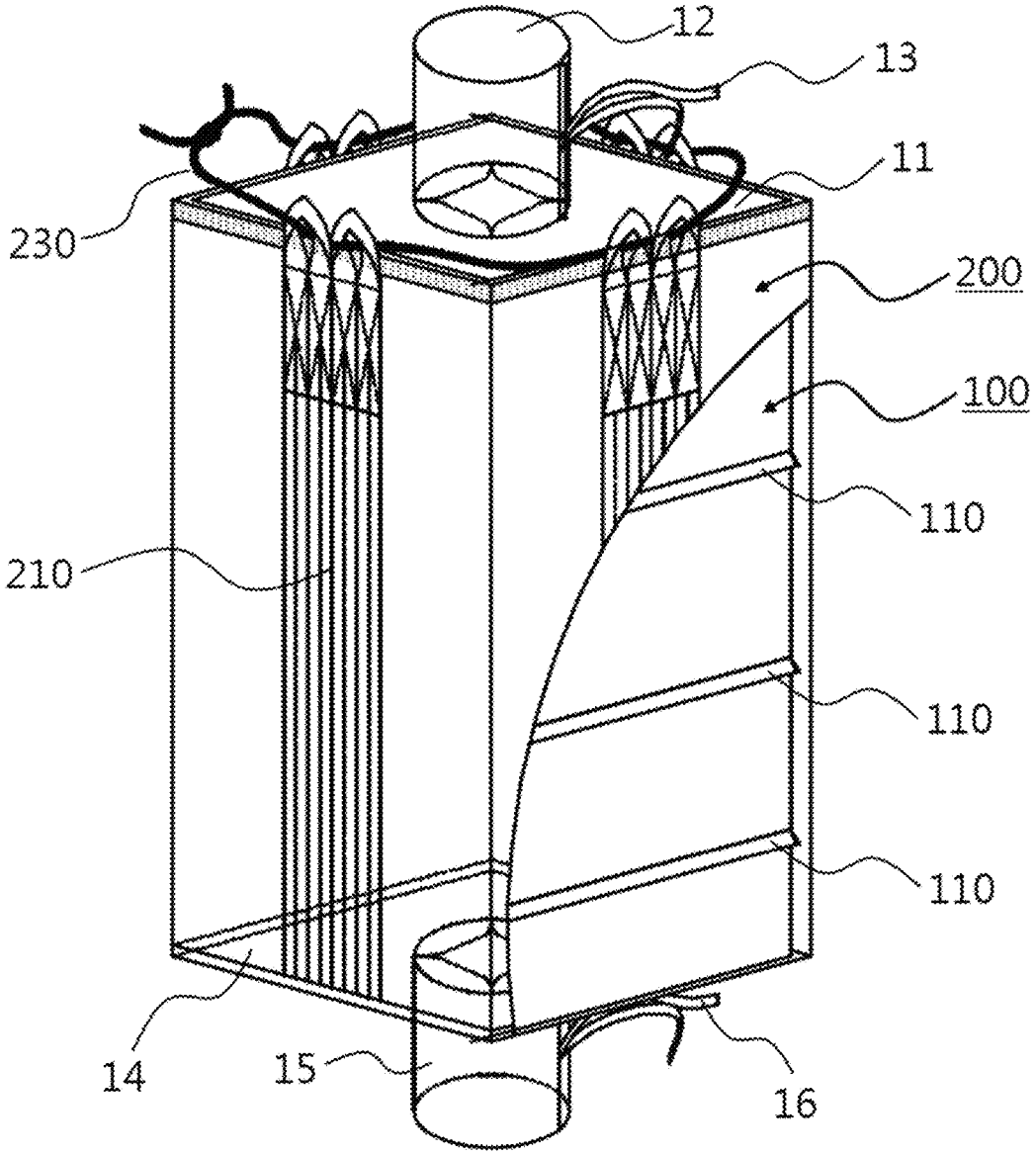
FIG. 7 shows both the structures of the outer bag and the inner bag in a state in which the inner bag has been inserted into the outer bag according to the present invention and part of the outer bag has been cut away.
Figure 8:
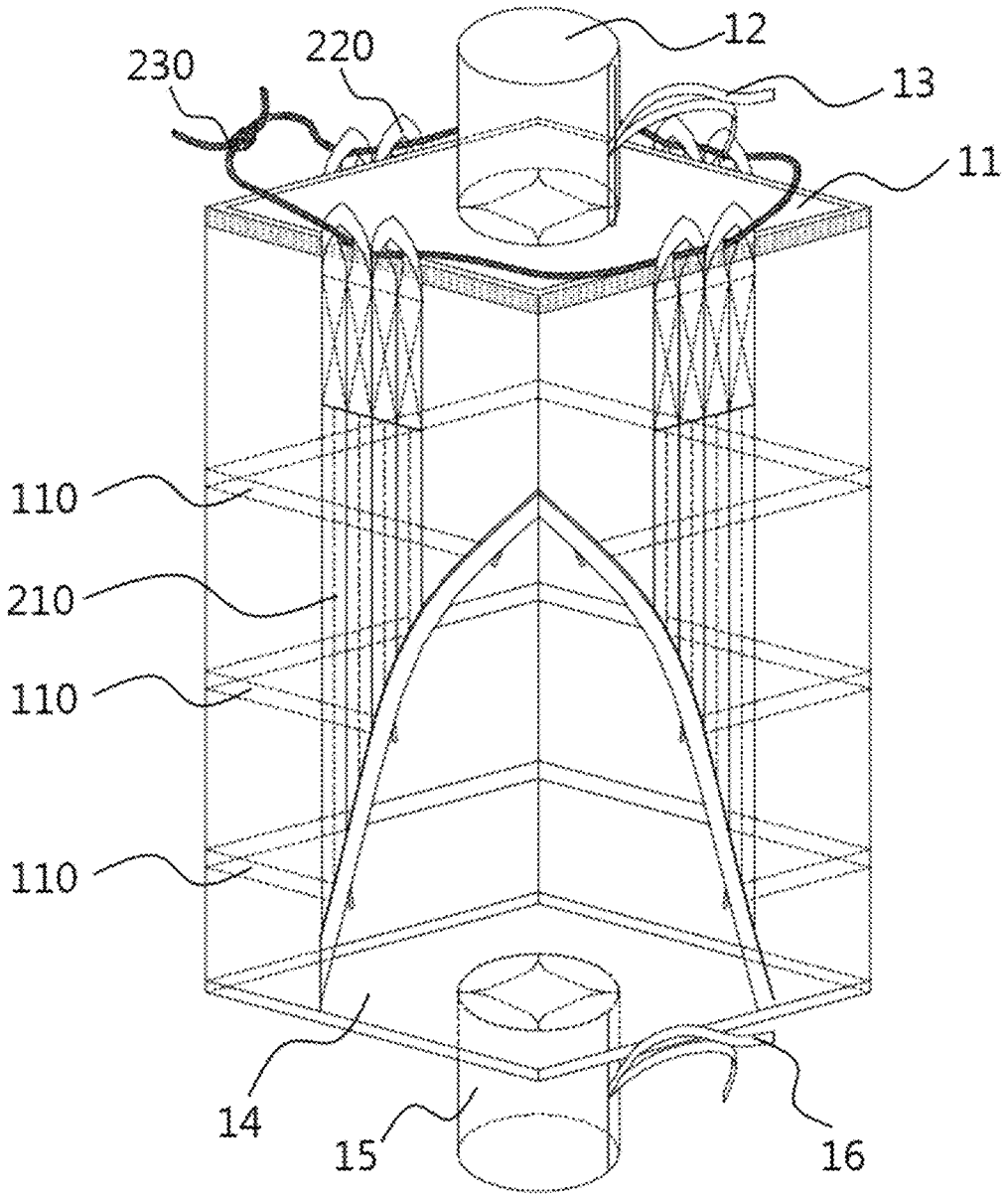
FIG. 8 shows the internal structure of the inner bag in a state in which the inner bag has been inserted into the outer bag according to the present invention and parts of the outer bag and the inner bag have been cut away.

According to the present invention, it is preferable that an upper plate 11 and a lower plate 14 are coupled to the open top and bottom of the container bag, respectively. As shown in FIG. 6, an introduction entrance 12 and a tightening strap 13 may be provided on the upper plate 11, and an exit 15 and a tightening strap 16 may be provided on the lower plate 14.

Meanwhile, depending on the type of contents introduced into the container bag, a lamination layer (not shown) configured to perform a function, such as a waterproof function, an anti-fouling function, an insulation function, or the like, may be required. It is preferable that the lamination layer is formed on at least one of the outside of the inner bag 100 and the inside of the outer bag 200. In this case, since the lamination layer and the charged materials do not contact each other, there is also the effect of preventing contamination due to contact with the lamination layer.

Furthermore, when contents introduced into the container bag are hygroscopic or powder materials, a liner (not shown) may be additionally disposed in the internal space of the inner bag 100.

While it is difficult to additionally dispose a liner inside a conventional inner bag in which partitions are formed, an advantage arises in that the liner can be freely disposed inside the container bag according to the present invention because the inner bag of the container bag does not include the partitions.

The insert-structured container bag having an inner bag inserted into an outer bag according to the present invention has the following advantages:

First, an advantage arises in that the lateral reinforcing portions are formed on the inner bag, and can thus prevent an expansion phenomenon.

Second, an advantage arises in that the vertical reinforcing portions are formed on the outer bag, and can thus prevent an expansion phenomenon and maintain the upright and rectangular parallelepiped shape of the container bag.

Third, an advantage arises in that when the container bag is lifted, forces are applied to adjacent lifting loops by the separate connection portion connecting the lifting loops, and can thus maintain an upright and rectangular parallelepiped shape while maintaining corners.

The advantage of the present invention are not limited to those mentioned above, and other advantages which are not mentioned can be clearly understood by those skilled in the art from the above detailed description.

The embodiments described herein and the accompanying drawings are intended merely to illustrate part of the technical spirit included in the present invention. Accordingly, the embodiments disclosed herein are not intended to limit the technical spirit of the present invention, but are intended to illustrate the technical spirit. Therefore, it will be apparent that the scope of the technical spirit of the present invention is not limited by the embodiments. All modifications and specific embodiments which can be easily derived by those skilled in the art within the range of the technical spirit included in the present specification and the accompanying drawings should be construed as falling within the range of the rights of the present invention.

What is claimed is:

1. An insert-structured container bag having an inner bag inserted into an outer bag, wherein:

the inner bag and the outer bag are formed separately;

the inner bag comprises one or more lateral reinforcing portions formed by folding the inner bag;

the outer bag comprises vertical reinforcing portions formed on respective side surfaces of the outer bag, lifting loops coupled to tops of the vertical reinforcing portions, and a connection portion passed through the lifting loops; and the one or more lateral reinforcing portions are formed by folding the inner bag outward in a lateral direction, and are disposed in a space between the inner bag and the outer bag.

2. The insert-structured container bag of claim 1, wherein each of the one or more lateral reinforcing portions has a structure in which a bent portion is completely sewn without an internal path, or a structure in which a bent portion is partially sewn with an internal path.

3. The insert-structured container bag of claim 2, wherein a reinforcing belt is inserted into the internal path.

4. The insert-structured container bag of claim 3, wherein the one or more lateral reinforcing portions comprise a plurality of lateral reinforcing portions, and strengths of the reinforcing belts increase in a downward direction.

5. The insert-structured container bag of claim 1, wherein the one or more lateral reinforcing portions comprise a plurality of lateral reinforcing portions, and heights H of the lateral reinforcing portions increase in a downward direction.

6. The insert-structured container bag of claim 1, wherein the one or more lateral reinforcing portions are three or more in number, and intervals of the lateral reinforcing portions decrease in a downward direction.

7. The insert-structured container bag of claim 1, wherein the vertical reinforcing portions are warp-reinforced woven portions which are woven such that warp more than weft is added thereto.

8. The insert-structured container bag of claim 1, wherein the vertical reinforcing portions are formed by adding reinforcing belts.

9. The insert-structured container bag of claim 1, wherein:

the vertical reinforcing portions are provided on center portions of the respective side surfaces of the outer bag; and the lifting loops are provided on tops of the vertical reinforcing portions.

10. The insert-structured container bag of claim 9, wherein a pair of the lifting loops are disposed in parallel at each of the tops of the vertical reinforcing portions.

11. The insert-structured container bag of claim 9, wherein tops of the lifting loops are disposed at a height identical to that of a top of the outer bag or are disposed above the top of the outer bag.

12. The insert-structured container bag of claim 1, wherein the connection portion is passed through the lifting loops which are opposite to each other with a corner of corresponding side surfaces of the container bag disposed therebetween.

13. The insert-structured container bag of claim 12, wherein the connection portion is passed through at least two lifting loops of the lifting loops.

14. The insert-structured container bag of claim 1, wherein the connection portion is provided in a belt or string shape.

15. The insert-structured container bag of claim 1, wherein an upper plate and a lower plate are coupled to an open top and bottom of the container bag, respectively.

16. The insert-structured container bag of claim 1, wherein a lamination layer is formed on at least one of an inside of the inner bag and an inside of the outer bag.

17. The insert-structured container bag of claim 1, wherein a liner is additionally disposed in an internal space of the inner bag.

* * * * *